United States Patent [19]

Beamenderfer et al.

[11] Patent Number: 4,880,388

[45] Date of Patent: Nov. 14, 1989

[54] ELECTRICAL CONNECTOR ASSEMBLY WITH LEAD FRAME

[75] Inventors: Robert E. Beamenderfer, Palmyra; William B. Long, Camp Hill; John R. Shuey, Mechanicsburg, all of Pa.

[73] Assignee: AMP Incorporated, Harrisburg, Pa.

[21] Appl. No.: 217,745

[22] Filed: Jul. 12, 1988

[51] Int. Cl.[4] ..... H01R 9/07

[52] U.S. Cl. ..... 439/108; 439/497; 439/516; 439/495

[58] Field of Search ..... 439/43, 49, 53, 92, 439/108, 492, 495, 497, 499, 77, 516, 885

[56] References Cited

U.S. PATENT DOCUMENTS

| | | | |
|---|---|---|---|
| 3,333,231 | 7/1967 | Travis | 439/516 |
| 3,905,665 | 9/1975 | Lynch et al. | 439/885 |
| 4,040,704 | 8/1977 | Huber . | |
| 4,094,566 | 6/1978 | Dola et al. . | |
| 4,140,360 | 2/1979 | Huber . | |
| 4,260,209 | 4/1981 | Zell et al. . | |
| 4,269,466 | 5/1981 | Huber . | |
| 4,279,074 | 7/1981 | Zell et al. . | |
| 4,464,003 | 7/1984 | Goodman et al. | 439/92 |
| 4,471,158 | 9/1984 | Roberts | 439/45 |
| 4,596,428 | 6/1986 | Tengler | 439/497 |
| 4,602,830 | 7/1986 | Lockard . | |
| 4,602,831 | 7/1986 | Lockard . | |
| 4,639,058 | 1/1987 | Morgan | 439/108 |
| 4,655,515 | 4/1987 | Hamsher, Jr. et al. . | |
| 4,681,382 | 7/1987 | Lockard | 439/92 |
| 4,682,840 | 7/1987 | Lockard | 439/874 |
| 4,737,117 | 4/1988 | Lockard | 439/92 |

*Primary Examiner*—Gary F. Paumen

*Attorney, Agent, or Firm*—Gerald K. Kita

[57] ABSTRACT

An electrical connector assembly 27 comprises, an insulative housing block 6, conductive signal contacts 1 mounted to the housing block 6 for connection to corresponding signal wires 23 of an electrical cable 22, and a conductive ground bus 2 for connection to corresponding ground wires 24 of the cable 22, the signal contacts 1 and the ground bus 2 are joined together and are mounted on the housing block 6, the signal contacts 1 are constructed for being detached from the ground bus 2, whereby selected signal contacts 1 are detached from the ground bus 2 and other signal contacts 1 remain joined to the ground bus 2.

16 Claims, 6 Drawing Sheets

ELECTRICAL CONNECTOR ASSEMBLY WITH LEAD FRAME

FIELD OF THE INVENTION

The invention relates to an electrical connector assembly for connection to an electrical cable, wherein the connector assembly includes signal contacts and a ground bus connected to selected signal contacts.

BACKGROUND OF THE INVENTION

A known electrical connector assembly is disclosed in U.S. Pat. No. 4,140,360 and comprises, an insulative housing block, conductive signal contacts mounted to the housing block for connection to corresponding signal wires of an electrical cable, and a conductive ground bus for connection to corresponding ground wires of the cable. The ground bus is a separate part with multiple tabs. Some of the tabs are removed. The tabs remaining on the ground bus connect with selected signal contacts when the ground bus is assembled in the connector assembly. After the tabs are removed, the ground bus is difficult to distinguish from another ground bus with different tabs removed. An incorrectly identified ground bus might be assembled in the connector assembly.

SUMMARY OF THE INVENTION

According to the invention, a connector assembly comprises signal contacts and a ground bus joined together and mounted on a housing block. By providing the ground bus and the contacts together, accidental assembly of an incorrect ground bus is prevented.

Further according to the invention, the contacts are constructed for being detached from the ground bus, whereby selected signal contacts are detached from the ground bus and other selected signal contacts remain joined to the ground bus. Thereby, the connector assembly provides an advantage of connecting the ground bus to selected signal contacts.

The connector assembly known from the patent requires separation of the signal wires from the ground wires of an electrical cable before the signal wires are connected to the signal contacts, and before the ground wires are joined to the ground bus. According to the invention the ground bus and the signal contacts are together and are spaced apart on the pitch spacing of the wires of the cable for connection to the wires without separating the signal wires from the ground wires.

The invention will now be described by way of example with reference to the accompanying drawings.

Figure 1:
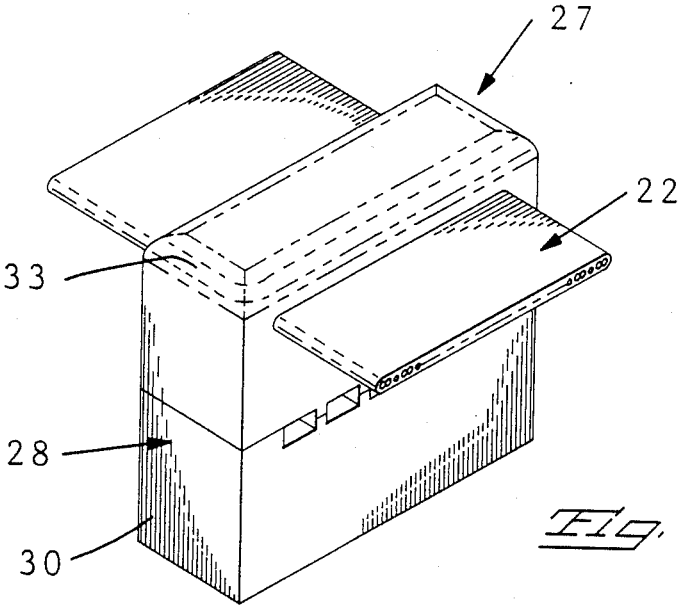
FIG. 1 is a perspective view of a connector assembly.
Figure 2:
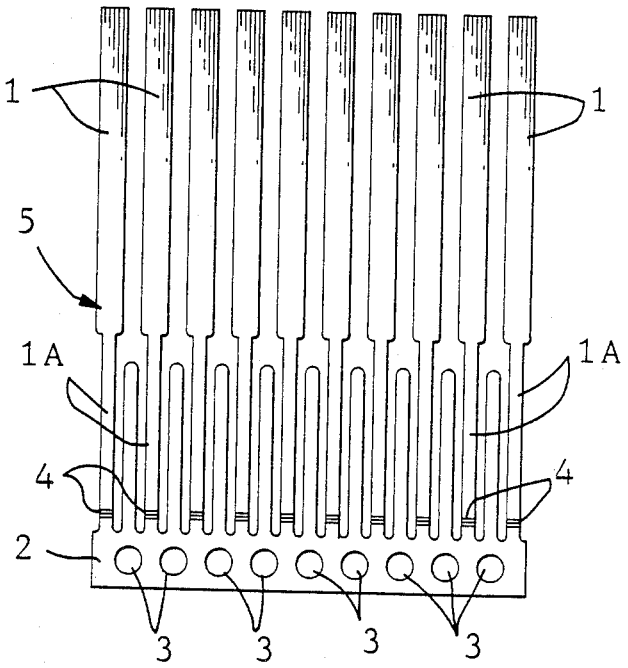
FIG. 2 is a plan view of portion of a ground bus joined to signal contacts in a lead frame construction.

With more particular reference to FIG. 2 of the drawings, elongated multiple signal contacts 1 project from an elongated ground bus 2. The contacts 1 and the ground bus 2 are cut out from a flat strip of metal by known stamping machinery, not shown. The ground bus 2 is provided along its length with a series of spaced apart pilot holes 3, which are customary and used in a known manner to advance he strip of metal along the stamping machinery. A groove 4, formed according to a customary operation of the stamping machinery, extends transversely across the length of each of the signal contacts 1. The signal contacts 1 remain joined to the ground bus 2 and provide a lead frame 5, known as an array of conductive paths for conducting electricity, with the paths joined together and cut out from a strip of metal.

Figure 4:
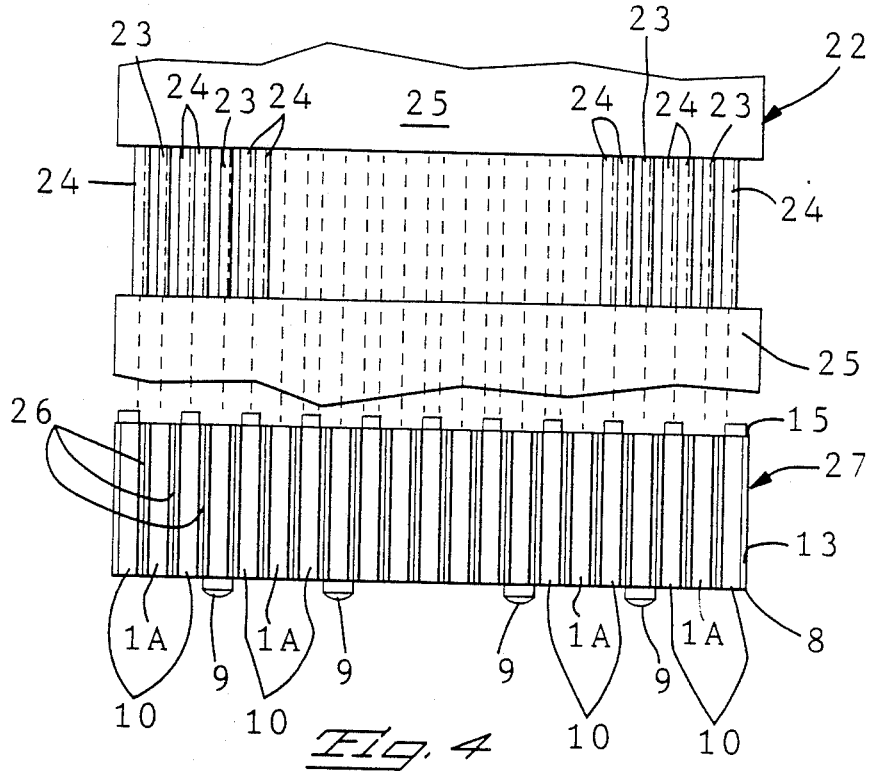
FIG. 4 is a plan view of a portion of the cable and the housing block with parts shown separated from one another.
Figure 3:
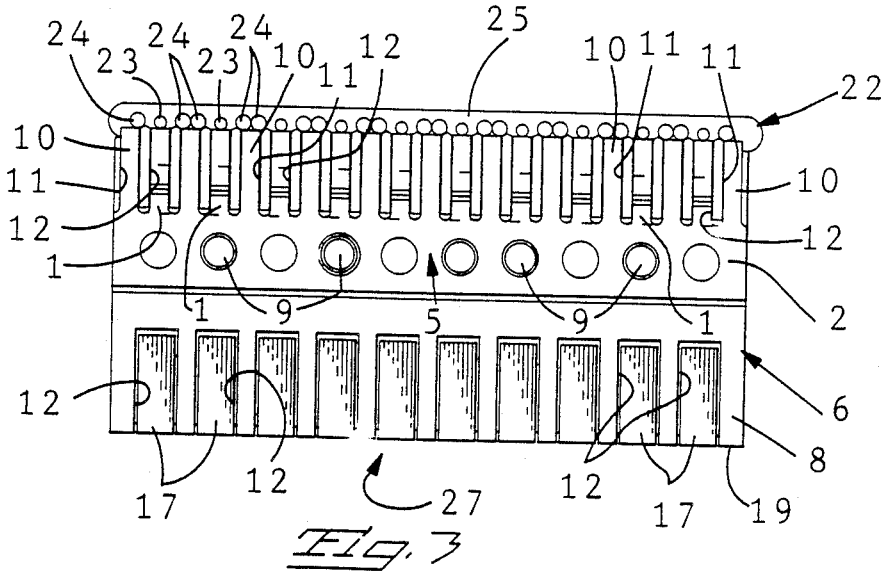
FIG. 3 is a front elevation view of a housing block of the connector assembly, together with a portion of an electrical cable.
Figure 5:
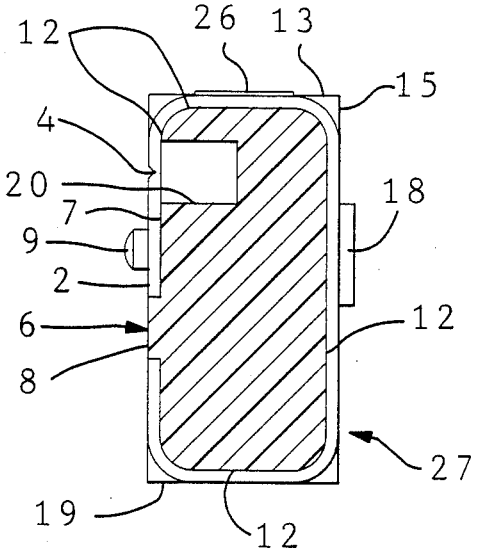
FIG. 5 is an elevation view of an end of the housing block.

With reference to FIGS. 3, 4 and 5, the lead frame 5 is assembled to an insulative housing block 6 by bending the lead frame 5 against the exterior of the housing block 6. The ground bus 2 nests within a recess 7 in a first side 8 of the housing block 6. Fasteners 9 that are secured to the housing block 6 project through corresponding pilot holes 3. For example, the fasteners 9 are rivets formed integral with the housing block 6. The rivets are spread to form enlarged heads that overlie the ground bus 2 and secure the ground bus 2 in place.

Elongated wire connecting portions 10 of the ground bus 2 and wire connecting portions of the signal contacts 1 nest along corresponding recesses 11,12 communicating with the recess 7 and extending along the first side 8 and along a second side 13 of the housing block 6.

Figure 6:
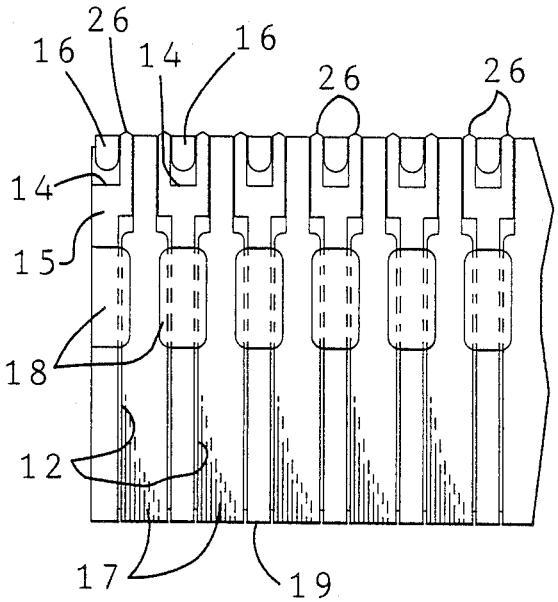
FIG. 6 is an elevation view of the rear of the housing block.

With references to FIG. 6, end portions 14 of corresponding recesses 11 extend to a third side 15 of the housing block 6. Ends 16 of the ground bus portions 10 are bent to extend to the third side 15 and terminate at the end portions 14 of the corresponding recesses 11. The signal contacts 1 are bent to extend along the third side 15 and past the ends 16 of the ground bus 2. The signal contacts 1 have widened portions to provide electrical contact portions 17. Fasteners 18, similar in construction as the fasteners 9, have spread heads that overlie and secure the contact portions 17 to the housing block 6. The electrical contact portions 17 are bent to extend along a fourth side 19 and to extend along a portion of the first side 8, and nest in widened portions of corresponding recesses 12 that extend along a portion of the third side 15, the fourth side 19 and a portion of the first side 8.

Figure 5A:
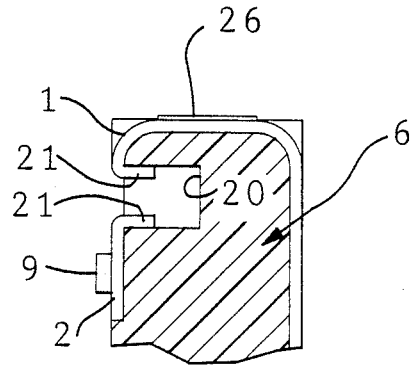
FIG. 5A is a view similar to FIG. 5 and illustrating a detached signal contact of the connector assembly.

With reference to FIGS. 5 and 5A, the contact portion 17 of each signal contact 1 extends across a corresponding cavity 20 in the first side of the housing block 6 with the groove 4 aligned with the cavity 20. Each signal contact 1 is constructed to be disconnected from the ground bus 2 by severing along the groove 4. Severed ends 21,21, FIG. 5A, of a severed signal contact 1 are then bent away from each other and to project into the corresponding cavity 20 to ensure their separation after disconnection of the severed signal contact 1 from the ground bus 2. Thereby, selected signal contacts 1 remain connected to the ground bus 2, and other selected signal contacts 1 are detached from the ground bus 2.

With reference to FIGS. 3 and 4, an electrical cable 22 of known construction includes parallel elongated signal wires 2 spaced apart on a pitch spacing, and parallel elongated ground wires 24 spaced apart on a corresponding pitch spacing. The wires 23,24 are arranged in an order, for example, such that each signal wire 23 is between two ground wires 24, the wires 23,24 are coplanar and spaced apart from each other and a bendable jacket 25 of insulative material encircles the wires 23,24.

The signal contacts 1 along the side 13 are held along the side 3 of the housing block spaced apart on a pitch spacing corresponding to the pitch spacing of the signal wires 23. The wire connecting portions 10 of the ground bus 2 are held along the side 3, extend between, and are coplanar beside wire connecting portions 1A of the signal contacts 1, and are spaced apart on a pitch spacing corresponding to the pitch spacing of the ground wires 24.

With reference to FIGS. 3 and 4, the wires 23,24 are exposed from the jacket 25 of the cable 22 and are maintained coplanar on their pitch spacings. Projecting barriers 26 of the housing block 6 extend between each of the recesses 11,12 for engaging and aligning corresponding wires 23,24 along the wire connecting portions 10 of the ground bus 2 and the signal contacts 1. The ground wires 24 engage and are joined, by soldering for example, to corresponding wire connecting portions 10 of the ground bus 2. The signal wires 23 engage and are joined, by soldering for example, to corresponding wire connecting portions of the signal contacts 1. Since the wire connecting portions 10 of the ground bus 2 and the signal contacts 1 are coplanar, the wires 23,24 are maintained coplanar and on their pitch spacing during the joining operation. The wire connecting portions 1A, 10 of the signal contacts 1 and of the ground bus 2 are transverse to the axis of the contact portions 17. The wire connecting portions 1A, 10 extend from one side of the connector assembly 27 to a second side 35, and are capable of assembly with the cable 22 without having to cut the cable 22. Thereby the cable 22 is able to daisy chain from one connector assembly 1 to other similar connector assemblies 1, not shown, spaced apart along the length of the cable 22.

Figure 8:
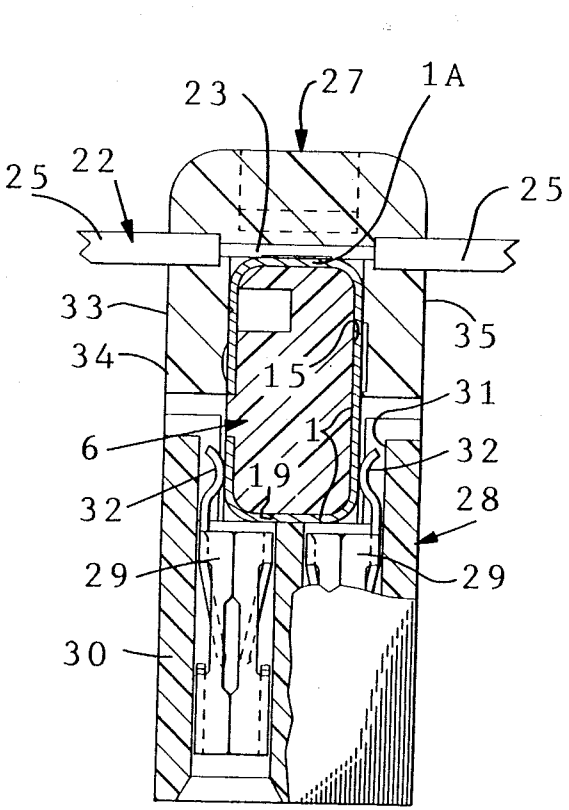
FIG. 8 is a view in section taken along the line 8—8 of FIG. 7.
Figure 7:
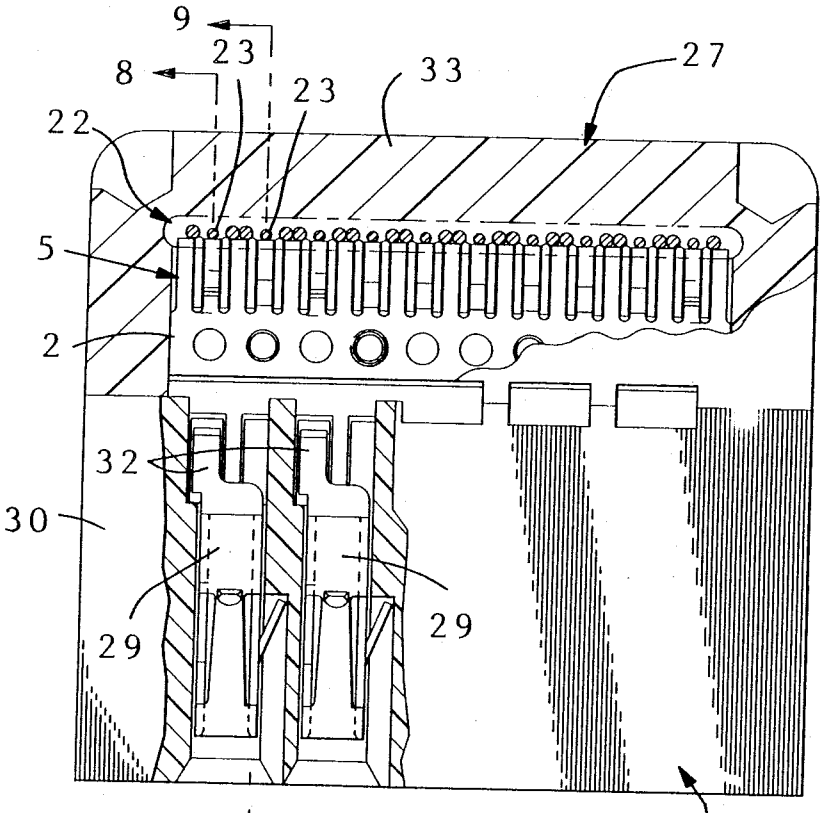
FIG. 7 is an elevation view partially in section of the connector assembly.
Figure 9:
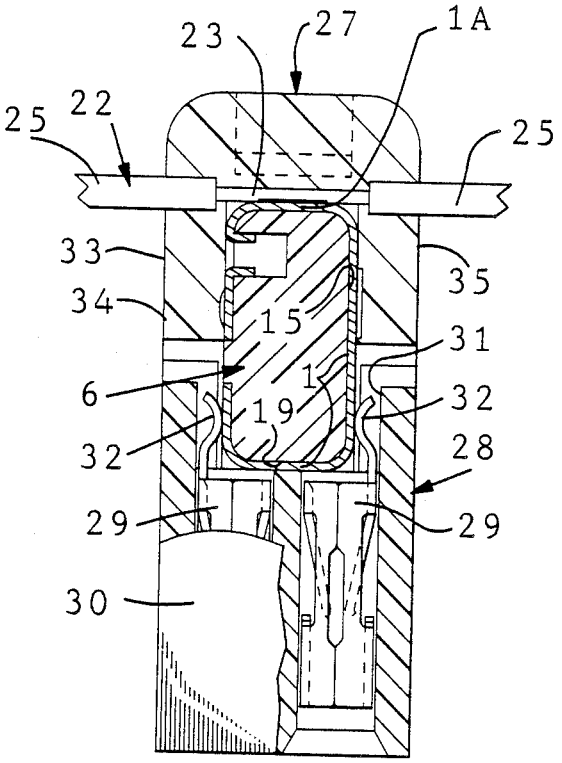
FIG. 9 is a view in section taken along the line 9—9 of FIG. 7.

The connector assembly 27 is connected to a second connector assembly 28 described with reference to FIGS. 7, 8 and 9. Known receptacle type electrical contacts 29 are mounted in an insulative second housing block 30. A recess 31 in an end of the second housing block 30 receives the housing block 6. Alternate signal contacts 1 that extend along the third side 15 of the housing block 6 are engaged by corresponding spring fingers 32 of corresponding contacts 29 aligned in a first row along the third side 15. Alternate signal contacts 1 along the fourth side 19 are engaged by corresponding spring fingers 32 of corresponding contacts 1 aligned in a second row along the first side 8. Thereby each signal contact 1 is engaged frictionally by a corresponding spring finger 32, that is then secured by solder or by welding. The connector assembly 27 further includes solidifiable insulative material 33 that is molded or cast in place while fluent. The molded material 33 adheres to and covers the lead frame 5 that would be exposed from the housing block 6. The molded material 33 also covers and adheres to the conductors 23,24 of the cable 22, that are connected to the lead frame 5, and a portion of the insulative jacket 25 of the cable 22; thereby providing an environmental seal or covering and a strain relief from the cable.

The connector assembly 27 is shown as being connected along the length of the cable 22 in daisy chain configuration wherein severing the conductors 23,24 of the cable 22 is not required. The cable 22 projects from one side 34 of the connector assembly, extends straight through the molded material 33 and projects from an opposite side 35 of the connector assembly 27. If desired, the cable 22 may be severed, not shown, for example, to end the cable 22 before it projects from the opposite side. The connector assembly 27 is a side entry cable assembly.

Figure 11:
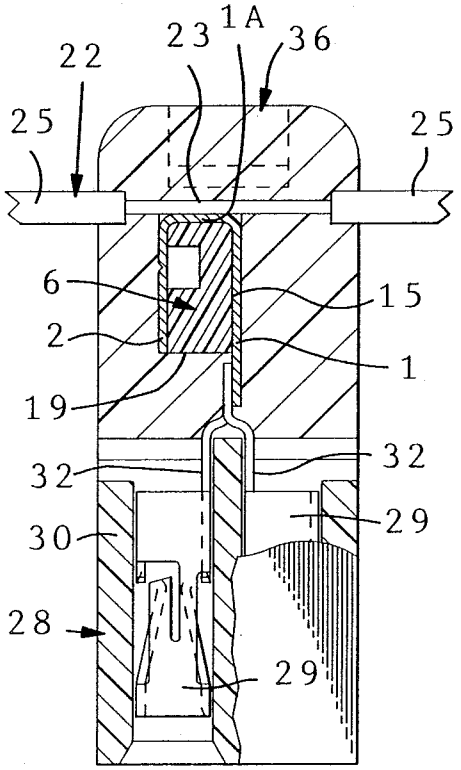
FIG. 11 is a view in section taken along the line 11—11 of FIG. 10.
Figure 10:
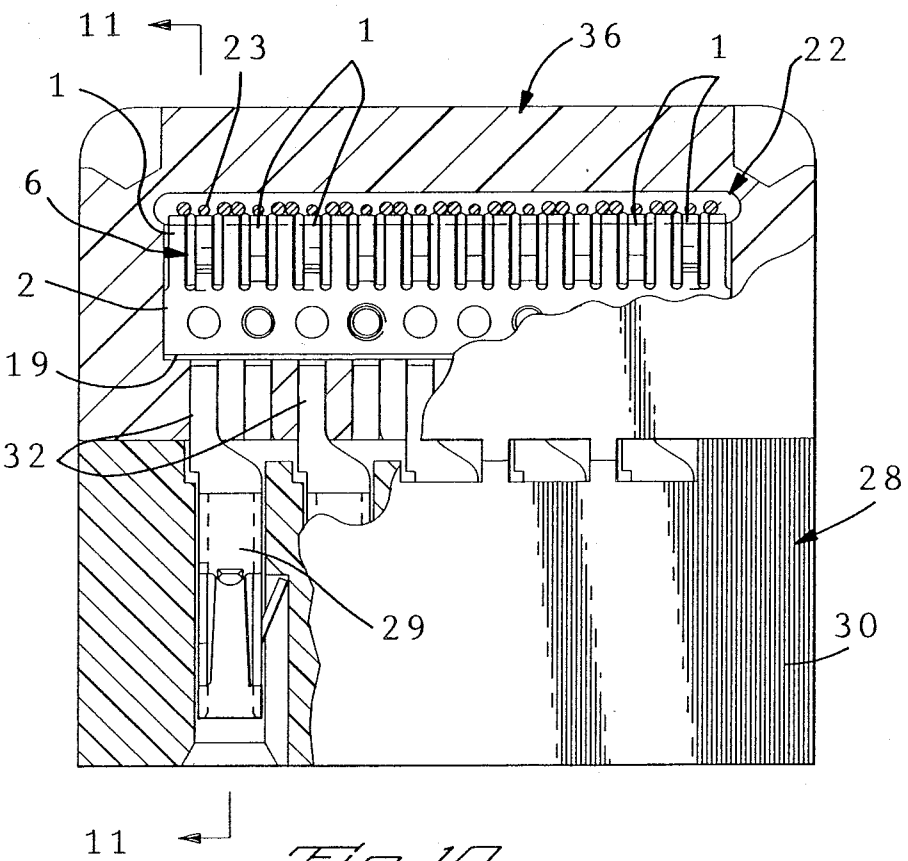
FIG. 10 is an elevation view partially in section of a connector assembly.

With reference to FIGS. 10 and 11, a connector assembly 36 is disclosed having the same construction as the connector assemblies 27 and 28, except for the following differences. The signal contacts 1 project outwardly from the housing block 6 without extending along the fourth side 19 of the housing block. The housing block 6 is shortened, by the fourth side 19 extending in a plane along an end of the of the ground bus 2. The known receptacle type electrical contacts 29 have corresponding contact fingers 32 extending from the second housing block 30. The fingers 32 are bent and are offset to a common plane. The fingers 32 of the contacts 29 in the corresponding row engage alternate signal contacts 1 projecting from the housing block 6. The fingers 32 are joined to the corresponding signal contacts 1 by welding or soldering. The molded material 23 covers the fingers 32 that project from the second housing block 30.

We claim:

1. In an electrical connector for connection to corresponding signal wires and corresponding ground wires of at least one electrical cable, the connector comprising: an insulative housing block, conductive signal contacts mounted to the housing block and having corresponding wire connecting portions adapted for connection to the corresponding signal wires, and a conductive ground bus having wire connecting portions adapted for connection to the corresponding ground wires, the improvement comprising:

the signal contacts and the ground bus are joined together and are mounted on the housing block prior to selected ones of the signal contacts being detached from the ground bus, means for detaching the signal contacts individually from the ground bus while the signal contacts and the ground bus remain mounted to the housing block, whereby the selected ones of the signal contacts are constructed for being detached from the ground bus, and at least one of the signal contacts remains joined to the ground bus, and the ground wires of said at least one electrical cable are connected to the wire connecting portions of the ground bus, and the signal wires of said at least one electrical cable are connected to the wire connecting portions of the signal contacts.

2. In an electrical connector as recited in claim 1, the improvement further comprising: the wire connecting portions of the signal contacts are spaced apart, and a corresponding one of the wire connecting portions of the ground bus extends between each pair of the wire connecting portions of the signal contacts.

3. In an electrical connector as recited in claim 1, the improvement further comprising: the ground bus and the signal contacts are formed from a strip of metal having a thickness, a series of pilot holes extend through the thickness, and fasteners on the housing block and extend through corresponding said pilot holes and through the thickness.

4. In an electrical connector as recited in claim 1, the improvement further comprising: said means comprise severable portions of the signal contacts.

5. In an electrical connector as recited in claim 1, the improvement further comprising: said means comprise severable portions of the signal contacts, each signal contact remaining joined to the ground bus having a corresponding severable portion extending across a corresponding recess in the housing, and each of said selected ones of the signal contacts having a corresponding severable portion projecting into and not across the corresponding recess.

6. In an electrical connector as recited in claim 1, the improvement further comprising:

first and second rows of contacts, a first group of alternate signal contacts extend along a side of the housing block and engage corresponding contacts of the first row of contacts, and a second group of alternate signal contacts extend along another side of the housing block and engage corresponding contacts of the second row of contacts.

7. In an electrical connector as recited in claim 1, the improvement further comprising:

the wire connecting portions of the ground bus and the wire connecting portion so the signal contacts extend coplanar in a row transverse to electrical contact portions of the signal contacts.

8. In an electrical connector as recited in claim 1, the improvement further comprising:

the signal contacts and the ground bus comprise a lead frame, and the lead frame is bent against the exterior of the housing block.

9. In an electrical connector as recited in claim 1, the improvement further comprising:

the wire connecting portions of the signal contacts nest in corresponding recesses in the housing block, and the wire connecting portions of the ground bus nest in corresponding additional recesses in the housing block.

10. In an electrical connector as recited in claim 2, 3, 4, 5, 6, 7, or 8, the improvement further comprising:

the wire connecting portions of the signal contacts nest in corresponding recesses in the housing block, and the wire connecting portions of the ground bus nest in corresponding additional recesses in the housing block.

11. In an electrical connector as recited in claim 2, 4, 5, 6, 7, 8, or 9, the improvement further comprising:

the ground bus and the signal contacts are formed from a strip of metal having a thickness, a series of pilot holes extend through the thickness, and fasteners on the housing block and extend through corresponding said pilot holes and through the thickness.

12. In an electrical connector as recited in claim 2, 3, 6, 7, 8, or 9, the improvement further comprising:

said means comprise severable portions of the signal contacts.

13. In an electrical connector as recited in claim 2, 3, 6, 7, 8, or 9, the improvement further comprising:

said means comprise severable portions of the signal contacts, each signal contact remaining joined to the ground bus having a corresponding severable portion extending across a corresponding recess in the housing, and each of said selected ones of the signal contacts having a corresponding severable portion projecting into and not across the corresponding recess.

14. In an electrical connector as recited in claim 1, the improvement further comprising:

first and second rows of contacts, a first group of alternate signal contacts extend along a side of the housing block and engage corresponding contacts of the first row of contacts, and a second group of alternate signal contacts extend along another side of the housing block and engage corresponding contacts of the second row of contacts.

15. In an electrical connector as recited in claim 2, 3, 4, 5, 6, 8, or 9, the improvement further comprising: the wire connecting portions of the ground bus and the wire connecting portions of the signal contacts extend coplanar in a row transverse to electrical contact portions of the signal contacts.

16. In an electrical connector as recited in claim 2, 3, 4, 5, 6, 7, or 9, the improvement further comprising:

the signal contacts and the ground bus comprise a lead frame, and the lead frame is bent against the exterior of the housing block.

* * * * *

UNITED STATES PATENT OFFICE

CERTIFICATE OF CORRECTION

Patent No. 4,880,388 Dated November 14, 1989

Inventor(s) Robert E. Beamenderfer, William B. Long, John R. Shuey

It is certified that error appears in the above-identified patent and that said Letters Patent is hereby corrected as shown below:

In claim 3, column 5, line 7, after "housing block" delete "and".

In claim 7, column 5, line 36, the word "portion" should be --portions-- and the word "so" should be --of--.

In claim 11, column 6, line 15, delete "and".

Signed and Sealed this

Thirtieth Day of October, 1990

*Attest:*

HARRY F. MANBECK, JR.

*Attesting Officer*

*Commissioner of Patents and Trademarks*